US010893712B2

(12) United States Patent
Turner

(10) Patent No.: US 10,893,712 B2
(45) Date of Patent: Jan. 19, 2021

(54) INDUCTION HEATING METHODS FOR BONDING SEAMS

(71) Applicant: NIKE, Inc., Beaverton, OR (US)

(72) Inventor: David Turner, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 347 days.

(21) Appl. No.: 15/765,413

(22) PCT Filed: Sep. 30, 2016

(86) PCT No.: PCT/US2016/054798

§ 371 (c)(1),
(2) Date: Apr. 2, 2018

(87) PCT Pub. No.: WO2017/062280

PCT Pub. Date: Apr. 13, 2017

(65) Prior Publication Data

US 2018/0295913 A1 Oct. 18, 2018

Related U.S. Application Data

(60) Provisional application No. 62/237,710, filed on Oct. 6, 2015.

(51) Int. Cl.

| | |
|---|---|
| ***A41D 27/24*** | (2006.01) |
| ***A41H 43/04*** | (2006.01) |
| *A41D 3/00* | (2006.01) |

(52) U.S. Cl.

CPC ..... *A41D 27/245* (2013.01); *A41H 43/04* (2013.01); *A41D 3/00* (2013.01); *A41D 2200/20* (2013.01); *A41D 2300/52* (2013.01)

(58) Field of Classification Search

CPC .. A41H 43/04; A41D 27/245; A41D 3200/52; A41D 2200/20; A41D 3/00

See application file for complete search history.

(56) References Cited

U.S. PATENT DOCUMENTS

| | | | |
|---|---|---|---|
| 2,425,194 | A | 8/1947 | Lendle |
| 2,554,307 | A | 5/1951 | Mccloskey, Jr. |

(Continued)

FOREIGN PATENT DOCUMENTS

| | | | |
|---|---|---|---|
| CA | 1231273 | A1 | 1/1988 |
| CN | 101910505 | A | 12/2010 |

(Continued)

OTHER PUBLICATIONS

Communication under Rule 71(3) dated Jul. 17, 2019 in European Patent Application No. 16781266.8, 29 pages.

(Continued)

*Primary Examiner* — Daniel McNally

(74) *Attorney, Agent, or Firm* — Shook, Hardy & Bacon L.L.P.

(57) ABSTRACT

Methods for bonding a seam using an inductively heated structure are provided. A three-dimensionally conformable structure is placed upon materials at a location of a desired seam for a clothing article. The structure contours to the surface and material as placed. The structure includes a conductive filling that may be inductively heated. The heated structure and conductive filling activate a heat-responsive adhesive at the location and bond the materials to one another to form the desired seam.

20 Claims, 8 Drawing Sheets

(56) References Cited

U.S. PATENT DOCUMENTS

| | | | | |
|---|---|---|---|---|
| 2,941,577 | A * | 6/1960 | Roseman | B29C 66/1122 156/274.4 |
| 3,528,867 | A * | 9/1970 | Heller, Jr. | B29C 66/81871 156/272.4 |
| 4,475,673 | A | 10/1984 | Ochiai | |
| 4,555,293 | A | 11/1985 | French | |
| 5,494,552 | A * | 2/1996 | Thompson | A41D 27/245 100/214 |
| 5,534,097 | A | 7/1996 | Fasano et al. | |
| 5,972,149 | A | 10/1999 | Schiller et al. | |
| 6,087,463 | A | 6/2000 | Tada et al. | |
| 6,087,640 | A | 7/2000 | Gillespie et al. | |
| 6,288,375 | B1 | 9/2001 | Lappi et al. | |
| 6,817,037 | B1 * | 11/2004 | King | B29C 65/48 2/275 |
| 8,828,167 | B2 | 9/2014 | Hannon | |
| 2006/0240234 | A1 | 10/2006 | O'Neill et al. | |
| 2007/0082165 | A1 | 4/2007 | Barrett | |
| 2011/0180531 | A1 | 7/2011 | Shinha | |
| 2012/0180191 | A1 | 7/2012 | Mcnamee | |
| 2013/0000811 | A1 * | 1/2013 | Engeldinger | C09J 11/04 156/60 |
| 2013/0255103 | A1 | 10/2013 | Dua et al. | |

FOREIGN PATENT DOCUMENTS

| | | | |
|---|---|---|---|
| CN | 104413823 | A | 3/2015 |
| DE | 0108648 | A1 | 8/2002 |
| WO | 2005093145 | A2 | 2/2005 |
| WO | 2014191562 | A1 | 5/2014 |

OTHER PUBLICATIONS

PCT International Preliminary Report on Patentability and Written Opinion dated Apr. 19, 2018 in PCT Application No. PCT/US2016/054798, 8 pages.

Seam Seal, "New Hotair Machines", Web page <http://www.seamseal.com/en/page/Machinery>, 2 pages, Jan. 22, 2013, retrieved from Internet Archive Wayback Machine <https://web.archive.org/web/20130122071648/http://www.seamseal.com/en/page/Machinery> on Jul. 9, 2018.

Sealers Unlimited, "Hand Held Crimper Sealers—Ultrasonic—Heat Wand—Clam Shell Sealers", Web page <http://www.agribags.com/hhc_hand_sealers.html>, 1 page, Oct. 6, 2008, retrieved from Internet Archive Wayback Machine <https://web.archive.org/web/20081006100204/http://www.agribags.com/hhc_hand_sealers.html> on Jul. 9, 2018.

PCT International Search Report and Written Opinion dated Dec. 20, 2016 in PCT Application No. PCT/US2016/054798, 11 pages.

* cited by examiner

INDUCTION HEATING METHODS FOR BONDING SEAMS

CROSS-REFERENCE TO RELATED APPLICATIONS

This application is a National Phase U.S. application of PCT Application No. PCT/US2016/054798, filed on Sep. 30, 2016, which claims priority under 35 U.S.C. 371 to U.S. Provisional Application Ser. No. 62/237,710, filed Oct. 6, 2015, both applications hereby being incorporated by reference.

BACKGROUND OF THE INVENTION

In the manufacture of clothing articles, non-linear, irregular, or curved seams may be difficult to affix or join together. In one example, these types of seams may be difficult to sew or stitch together. In another example, typical heat presses may be used to bond or affix seams. These heat presses generally have planar surfaces, and these planar surfaces work best on planar seams. Traditional heat presses are ill-adapted for use on curved or non-planar seams. As such, these seams may not be properly bonded and may suffer from structural deficiencies or weaknesses.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

In brief, and at a high level, the present invention is directed to methods for bonding clothing article seams using induction heating. In some aspects, an electromagnetic field is used to inductively heat a structure having three-dimensional deformability, where the structure is located at a desired seam location of a clothing article in order to transfer heat to an adhesive and bond the seam. By using a structure having three-dimensional deformability, the structure can be used on irregular or curved seams. More specifically, the three-dimensional deformability of the structure enables it to closely conform to the irregular or curved seam such that bonding is enhanced or facilitated.

In further aspects, the electromagnetic field may be used to directly inductively heat an adhesive having ferromagnetic particles. In yet other aspects, the electromagnetic field is used to inductively heat ferromagnetic materials integrated into targeted portions of fabric, such that the targeted portions correspond to seams in a constructed garment.

BRIEF DESCRIPTION OF THE DRAWING

Aspects are described in detail below with reference to the attached drawing figures, wherein.

DETAILED DESCRIPTION OF THE INVENTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

Aspects of the present invention are directed to induction heating methods for bonding seams in the manufacture of clothing articles. In one aspect, a structure having three-dimensional conformability or deformability is placed on materials used to construct a clothing article at a desired location of a seam. Generally, the structure encloses a ferromagnetic material, such as iron, nickel, and/or cobalt for example, that is heated using an electromagnetic field. When heated, the enclosed ferromagnetic material in the structure transfers heat to a heat-activated and/or heat-set adhesive placed between fabric panels in order to form a seam. In further aspects, the adhesive includes ferromagnetic materials that may be inductively heated to activate heat-responsive adhesives. In additional or alternative aspects, the fabric layers or panels used to construct the clothing article integrate ferromagnetic materials that may be inductively heated to set or cure an adhesive. Accordingly, ferromagnetic materials may be found in the structure, an adhesive, fabric materials, or a combination thereof in aspects of the methods described herein. The mechanics of induction heating through the generation of an oscillating magnetic field is not explained in detail here, as the technicalities will be understood by those having ordinary skill in the art.

Figure 1:
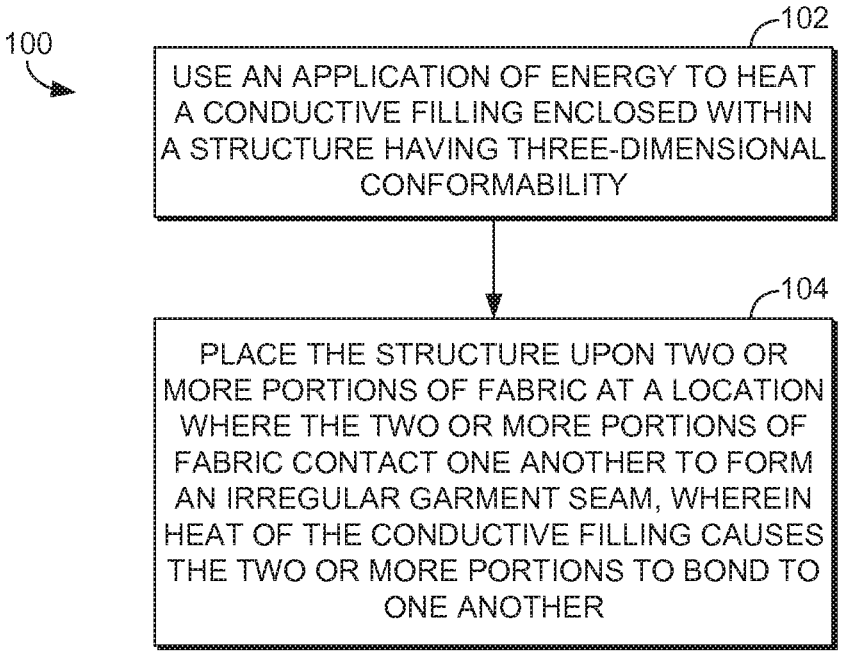
FIG. 1 is a flow diagram of an exemplary method for using an inductively heated structure to bond seams in accordance with aspects herein.

At FIG. 1, an exemplary method 100 for using a heated structure to bond garment seams is provided. The method 100 includes using an application of energy to heat a conductive filling enclosed within a structure having three-dimensional conformability, shown at block 102. The method 100 further includes placing the structure upon two or more portions of fabric at a location where the two or more portions of fabric contact one another to form an irregular garment seam, wherein heat of the conductive filling causes the two or more portions to bond to one another. In one aspect, the structure having three-dimensional conformability is placed on the fabric prior to the application of energy. In an alternative aspect, the structure having three-dimensional conformability is placed on the fabric after the application of energy. Any and all such aspects, and any variation thereof are contemplated as being within the scope herein.

At a high level, the application of energy includes generating an electromagnetic field using an alternating current (i.e., "AC") and an electromagnet. The alternating current may be high frequency, in some aspects. Ferromagnetic materials within the electromagnetic field are inductively heated, as will be understood by those having skill in the art. Exemplary ferromagnetic materials include iron, nickel, and cobalt, for example. Non-ferrous materials are contemplated to be within the scope of this disclosure, as induction heating technology advances to enable heating of non-ferrous materials such as copper and aluminum, for example. In aspects, the alternating current may not be high frequency, as the frequency and/or frequency range employed generally depends on material-specific resistance, thickness, and size, in some aspects. For the purposes of simplicity, the Description refers generally to ferromagnetic materials.

In order for the structure to be inductively heated via the application of energy, the structure includes a conductive filling. In aspects, the conductive material is enclosed completely within the structure. For example, the conductive material is sealed within a bag-like structure. The term conductive is used herein to describe materials that conduct energy, such as heat and/or electricity. In some aspects, at least a portion of the conductive filling is a ferromagnetic material. In further aspects, the conductive filling consists entirely of ferromagnetic materials. Generally, ferromagnetic materials also have the ability to conduct heat. By generating an electromagnetic field at or near the structure, the conductive filling having ferromagnetic material is inductively heated. Unlike conventional heating methods, the structure does not require actual physical contact with a heat-conducting source in order to heat the ferromagnetic materials. And unlike conventional heating methods, induction heating enables especially rapid heating of ferromagnetic materials. Further, induction heating produces consistent, uniform heating of ferromagnetic materials, which prevents "hot spots." Induction heating also reduces energy consumption, making its use energy efficient. And because induction heating heats a ferromagnetic material itself, there is no hot surface on which a person may be burned or to which flammable materials may be exposed, for example. This may reduce the risk of injury and unsafe conditions.

Additionally, the structure has three-dimensional conformability. As used throughout this disclosure, the term "three-dimensional conformability" means that that the structure is able to conform to any surface upon which the structure is placed. The three-dimensional conformability facilitates increased contact of the structure with the surface. For example, when the structure is placed on a flat surface, the structure flattens out to maximize contact of the structure with the flat surface. In another example, when the structure is placed on a rounded, convex surface, the structure forms a concave-shaped contact surface that contours to the rounded, convex surface. In aspects, the structure may be laid or draped upon a surface in order to facilitate a contoured contact between the structure and the surface. In some aspects, the amount (e.g., surface area) of contact between the structure and a surface may be increased and/or maximized depending on the materials used to construct the structure, the dimensions of the structure, the materials of the conductive filling, and the dimensions or volume of the conductive filling materials within the structure. In aspects, the structure may be constructed of a flexible fabric or material.

The conductive filling may include a plurality of similarly shaped objects, such as pellets or beads. Alternatively, the conductive filling may include a plurality of irregularly shaped objects, such as shavings or filings. Generally, the plurality of objects may be similar in size to one another, independent of shape. The plurality of objects may be smaller in size when compared to the overall size of the structure. Exemplary conductive fillings include filings, shavings, beads, pellets, or a combination thereof, at least a portion of which include a ferromagnetic material that may be inductively heated. In one example, the conductive filling includes iron filings, wherein the iron may be inductively heated and further, may conduct heat, such as ceramic pellets. In another example, the conductive filling includes a mixture of iron filings and copper pellets, such that only the iron filings are inductively heated but both the iron filings and copper pellets conduct heat. In such an example, the copper pellets are actually heated by the iron filings via conduction, and in turn, may conduct heat to set or cure an adhesive. Copper may be used in the conductive filling, for example, because of its superior heat conduction properties that may surpass those of other materials, including ferromagnetic materials. The compositional make-up of the conductive filling may be determined so as to maximize heat conduction of the conductive filling and structure, for example. Additionally or alternatively, the compositional make-up of the conductive filling may be determined so as to minimize the amount of time necessary for inductively heating the conductive filling and structure (e.g., materials having high electric resistance may heat up quickly and retain energy longer). Any number of combinations of ferromagnetic materials with non-ferrous, conductive materials is contemplated to be within the scope of the Description. As inductive heat technology progresses, an entirely non-ferrous, conductive filling is contemplated to be within the scope this Description.

Regarding the conductive filling, the dimensions and volume of the plurality of objects are relative to the volume of the structure having three-dimensional conformability. The dimensions and/or volume of the objects are such that the objects easily and freely move within the structure and around one another. For example, each individual object may have a volume approximately 1/50th of the total volume of the structure. In another example, each individual object may have a volume in the range of 1/500th and 1/1000th of the total volume of the structure. In yet another example, the plurality of individual objects, together, may have a volume in the range of 40% to 60% of the total volume of the structure. These ratios and percentages are merely for illustrative purposes. Generally, the dimensions and/or volume of each individual object are comparatively smaller than the overall structure, thereby allowing a plurality of the objects to be held or stored within the structure.

Additionally, the conductive filling may partially fill the interior volume of the structure in which it is enclosed. By partially filling the structure with the plurality of objects, such as iron filings, for example, the iron filings may easily shift and move around, spilling over one another as the structure is manipulated, moved, and/or placed on a surface. As such, the conductive filling has some freedom of movement as enclosed within the structure. This freedom of movement within the partially filled structure imbues the structure with flexibility and malleability, similar to a beanbag, for example. In one example, a structure that is filled to 40% of its volume with conductive filling has greater flexibility than a structure that is filled to 75% of its volume with the same conductive filling, as the conductive filling has more volume and space to move around within the structure. Increased three-dimensional conformability may facilitate increased contact of the structure with a surface on which the structure is placed. Further, the weight of the conductive filling may further provide the structure with support from within, such that the structure may stay in one place when manipulated. For example, a structure that is filled to 60% of its internal volume with conductive filling has more structural integrity than a structure that is filled to 30% of its internal volume with the same conductive filling. In such an example, the 60% filled structure may be configured to stand upright, or on one side, or leaning without requiring other means of support, such that the conductive filling serves as a weighted base for the structure. In this way, the weight of the conductive filling may act to anchor the structure such that the structure stays in a place or position once placed. Therefore, when the structure having three-dimensional conformability is placed upon two or more portions of fabric at a location where the two or more portions of fabric contact one another to form an irregular garment seam, the structure stays in place at the location. As such, energy may be applied to heat the conductive filling enclosed within the structure having three-dimensional conformability and facilitate bonding of the two or more portions of fabric.

Figure 2:
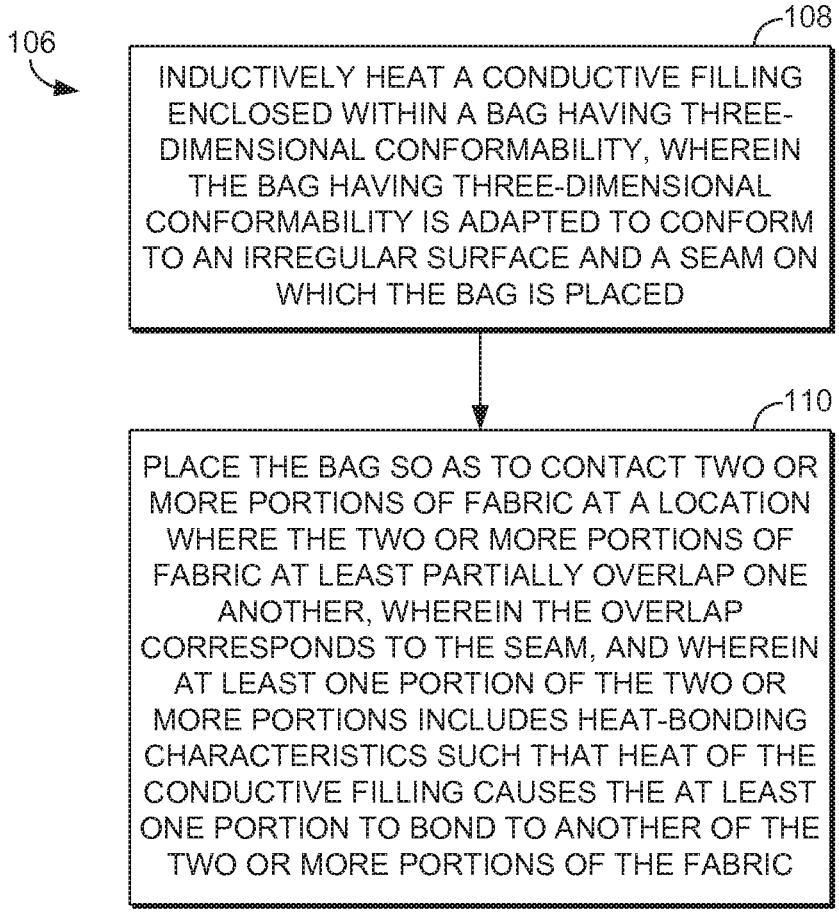
FIG. 2 is a flow diagram of an exemplary method for using an inductively heated structure to bond seams in accordance with aspects herein.

With reference to FIG. 2, it provides an exemplary method 106 for using an inductively heated structure to bond garment seams. The method 106 includes inductively heating a conductive filling enclosed within a structure having three-dimensional conformability, shown at block 108. The structure is placed so as to contact two or more portions of fabric at a location where the two or more portions at least partially overlap one another, shown at block 110, where the overlap corresponds to one or more of an irregular surface or a seam. At a high level, the two or more portions of fabric correspond to one or more pieces of a garment pattern. In one aspect, the two or more portions at least partially overlap one another, independent of similarity in size or shape of the two or more portions. In another aspect, the two or more portions completely or nearly completely overlay one another, wherein the two or more portions may be similar in size or shape. In some aspects, a heat-set or heat-curing adhesive is placed between the two or more portions near, at, or within the overlap location or an area of overlap. Then, the heat from the structure causes at least one portion to be affixed to another of the two or more portions of the fabric, as a result of the method 106. The portions may bond to one another as heat from the conductive filling of the structure sets and/or cures the adhesive.

In some aspects, the structure may be used to bond a seam that is irregular in shape. An irregular seam is a seam that is not uniform, is not straight, or is not linear, for example. In other aspects, an irregular seam is a seam that is difficult to sew, stitch, or heat press in a time efficient manner and/or without manufacturing defects. Further, in some aspects, at least one portion of the two or more portions of fabric has heat-bonding characteristics such that heat of the conductive filling causes the portion to bond to another of the two or more portions of the fabric.

As described herein, the structure is three-dimensionally conformable. The structure may be malleable such that the structure may be bent, reshaped, and/or twisted, for example. The three-dimensionally conformable structure is adapted or configured to conform to an irregular surface on which the structure is placed, in aspects. An irregular surface is a surface that is not uniformly flat (e.g., limited to two dimensional features and/or planar). For example, a surface that includes one or more of a convex curvature, a concave curvature, a slope, a grade, a point, a peak, a bump, a divot, an edge, or a combination thereof, may be described as an irregular surface. Because the structure may contour to an irregular surface, the structure may be placed on fabrics draped over or secured to shaped forms, for example. The structure contours to the forms and the fabric thereon, providing increased or maximized contact with the fabric.

Figure 3:
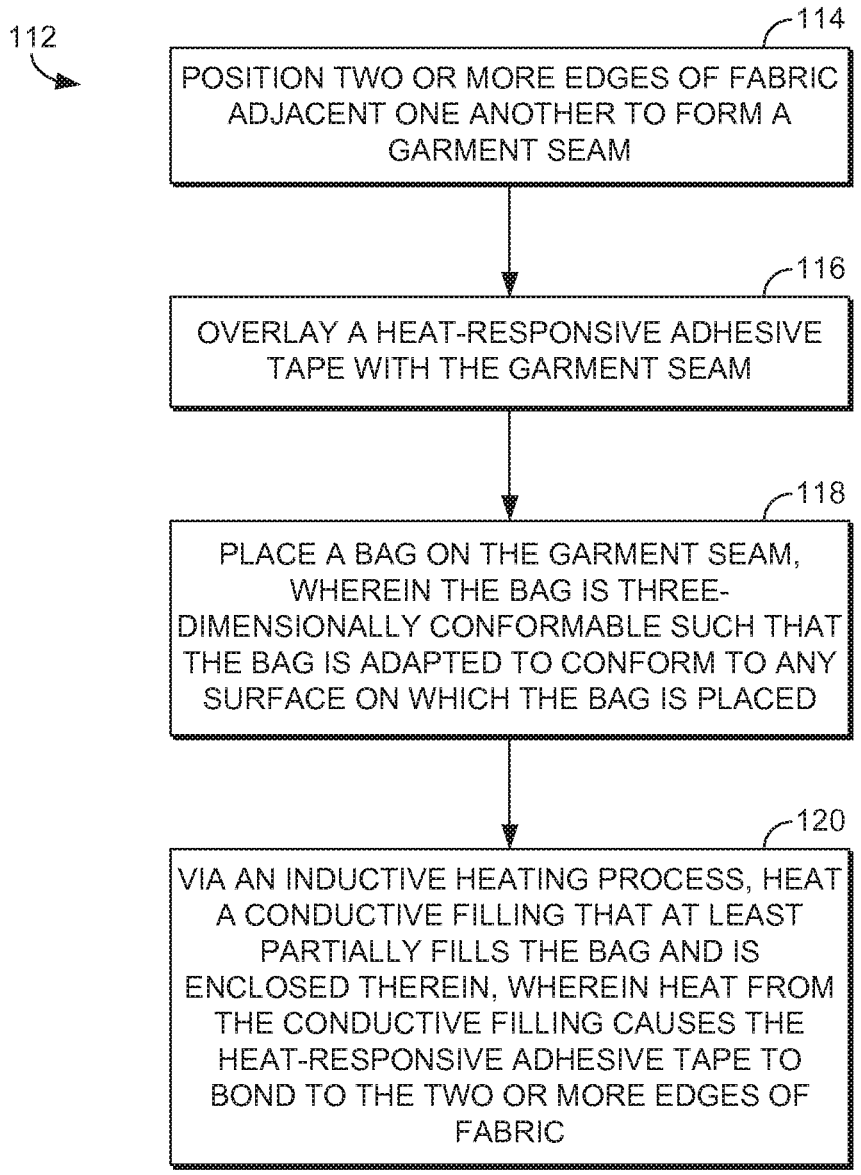
FIG. 3 is a flow diagram of an exemplary method for using an inductively heated structure to bond seams in accordance with aspects herein.

In FIG. 3, another exemplary method 112 for using an inductively heated structure to bond irregularly shaped garment seams is provided. The method 112 begins by positioning two or more edges of fabric adjacent one another to form a garment seam, shown at block 114. Then, at block 116, a heat-responsive adhesive tape is overlaid with the garment seam. In one aspect, the heat-responsive adhesive tape is placed to overlap a portion of each of the edges. In another aspect, the heat-responsive adhesive tape is placed between two portions of the fabric along the edges, for instance. The method further includes placing a structure on the garment seam, wherein the structure is three-dimensionally conformable such that the structure is adapted to conform to any surface on which the structure is placed, at block 118. Then, a conductive filling that at least partially fills the structure and is enclosed therein is heated via an inductive heating process, such that the heat from the conductive filling causes the heat-responsive adhesive tape to bond to the two or more edges of fabric, as shown at block 120.

It should be understood from the Description of the exemplary methods herein that the structure may be heated before or after the structure is placed as desired, such that the methods described herein should not be construed as limiting in order or sequence.

Figure 4:
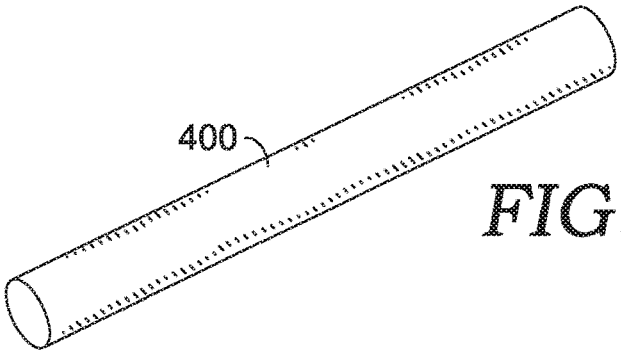
FIG. 4 is an exemplary structure for bonding garment seams in accordance with aspects herein.
Figure 5:
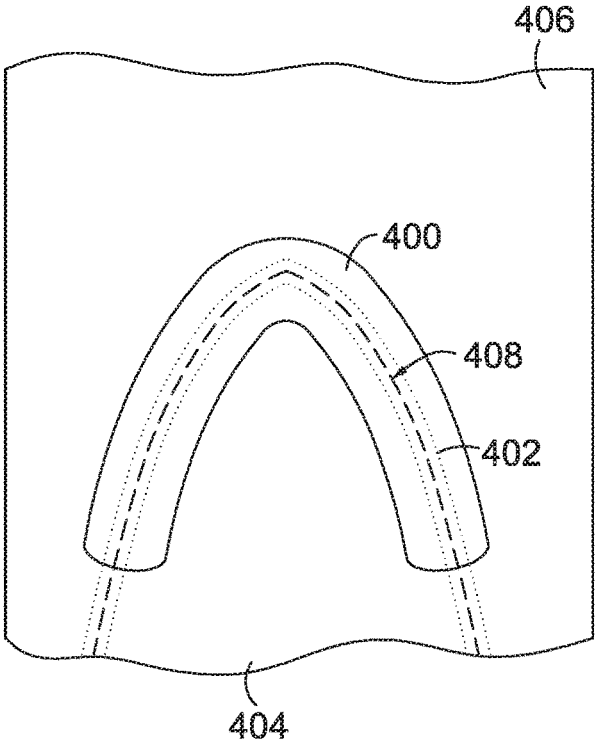
FIG. 5 illustrates the application of the exemplary structure of FIG. 4 to a seam in accordance with aspects herein.

Turning to FIGS. 4 and 5, these figures depict a perspective view of an exemplary structure 400 and a plan view of the placement of the structure 400 upon materials to be bonded to form a seam. In an exemplary aspect, the structure 400 may be tube-like (e.g., elongated with round sides and opposing truncated ends) in shape and dimension, and may be partially filled with a conductive filling, such as iron filings. As placed in FIG. 5, the structure 400 contacts materials so that inductively heating the conductive filling facilitates bonding of the materials. In one aspect, a heat-setting or heat-curing adhesive 402 (e.g., adhesive film or adhesive strip) may be placed between two fabric portions (e.g., overlapping edges or overlaid portions) along the desired seam location 408. Such an adhesive 402 may be placed at, near, within, or along the area of overlap of a first portion 404 and second portion 406 of fabric. The application of energy to the structure 400 placed at the desired seam location 408 or the application of the heated structure 400 to the desired seam location 408 causes the adhesive 402 to bond the two fabric portions (e.g., the first portion 404 and second portion 406 at or near the area of overlap forming the desired seam 408.

In a further aspect, a heat-setting or heat-curing adhesive 402 (e.g., adhesive film or adhesive strip) that contains ferromagnetic material may be place at, near, within, or along the area of overlap for forming the desired seam 408. In such an aspect, energy is supplied to both the structure 400 and the adhesive 402 containing ferromagnetic materials, thus inductively heating the structure 400 and the ferromagnetic materials contained in the adhesive 402. As such, the structure 400 and the adhesive 402 are inductively heated in tandem so as to set and/or cure the adhesive 402 so as to bond the first and second portions 404 and 406 of fabric. Using the structure 400 together with the adhesive 402 containing ferromagnetic materials facilitates faster heating times and less heat stress on the fabric portions. Additionally, placing the structure 400 on top of the desired seam having the ferromagnetic-containing adhesive 402 may increase and/or ensure sufficient or total contact of the adhesive 402 with the fabric portions 404 and 406 to be bonded. In this way, the final, formed seam may be secured or sealed such that weak bonding points are avoided and there are no gaps in the final seam.

In yet another aspect, a heat-setting or heat-curing adhesive 402 (e.g., adhesive film or adhesive strip) may be placed along the desired seam 408 wherein the fabric itself or a portion thereof includes and/or integrates ferromagnetic materials (e.g., fabric woven or knit with conductive fibers). In some aspects, the portion of the fabric that integrates ferromagnetic materials corresponds to the area of overlap. The application of energy to the desired seam 408 having integrated ferromagnetic materials causes the adhesive to bond the fabric and/or other materials together. Additionally, the structure 400 may be used in tandem with fabrics having integrated ferromagnetic materials to ensure a sufficient setting or curing temperature is met or exceeded.

Figure 6:
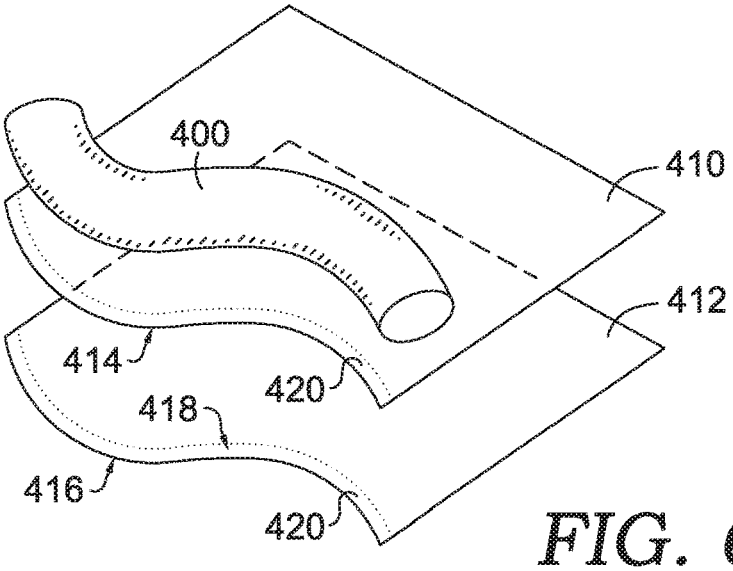
FIG. 6 is an expanded view that illustrates the application of the exemplary structure of FIG. 4 to a seam in accordance with aspects herein.

Whereas FIG. 5 illustrates an aspect where the two or more portions at least partially overlap one another, independent of similarity in size or shape of the two or more portions, FIG. 6 illustrates another aspect. FIG. 6 depicts an expanded view of two portions of fabric to be bonded together using structure 400, for example, to form a seam that corresponds to edges of the two portions of fabric. As shown, a third portion 410 and fourth portion 412 may be layered on one another such that a first edge 414 of the third portion 410 is aligned with a second edge 416 of the fourth portion 412. As shown, the third and fourth portions 410 and 412 completely or nearly completely overlay one another, wherein the third and fourth portions 410 and 412 may be similar in size and shape. As layered, in some aspects, the face sides of each of the two or more portions of fabric face each other. A face side or "right" side refers to a side of fabric that is configured to face outward when a finished garment is worn and is outwardly visible. Opposite a face side is a "wrong" side or back side of a piece of fabric. In some layered aspects, the fabric may be configured such that the face side and back side are visually indistinguishable from one another.

In some aspects, the third and fourth portions 410 and 412 may be layered with a strip of heat-responsive adhesive tape 418. The heat-responsive adhesive tape 418 may be placed between the third and fourth portions 410 and 412 along the first edge 414 and second edge 416. The heat-responsive adhesive tape 418 may further correspond to an area of overlap 420 shared by the third and fourth portions 410 and 412, in some aspects. Once the third and fourth portions 410 and 412 are layered, a structure such as exemplary structure 400, may be placed upon the layered portions in order to heat the heat-responsive adhesive tape 418 placed there-between. As such, the portions may be bonded to one another along the first edge 414 and second edge 416.

Figure 7:
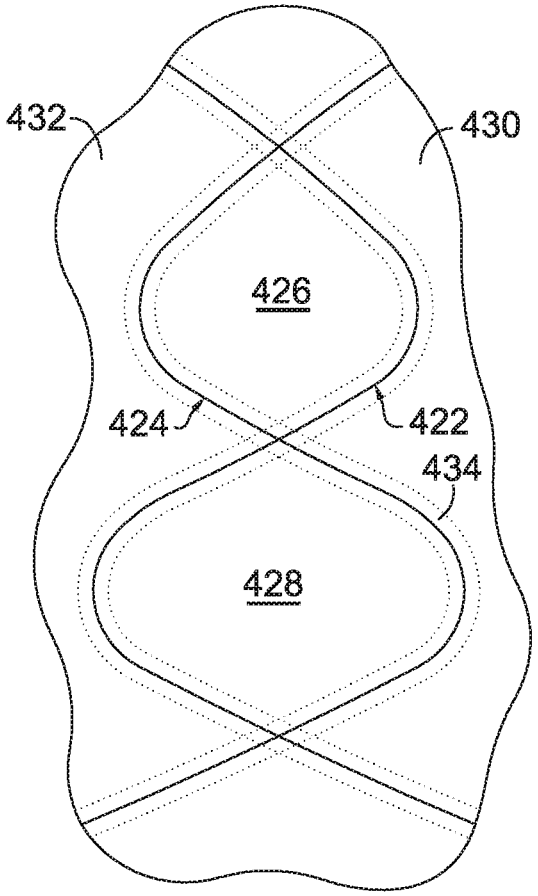
FIGS. 7 and 8 illustrate a plan view of exemplary seams that may be bonded using the exemplary structure of FIG. 4 and/or the exemplary methods of FIGS. 1-3 in accordance with aspects herein.
Figure 8:
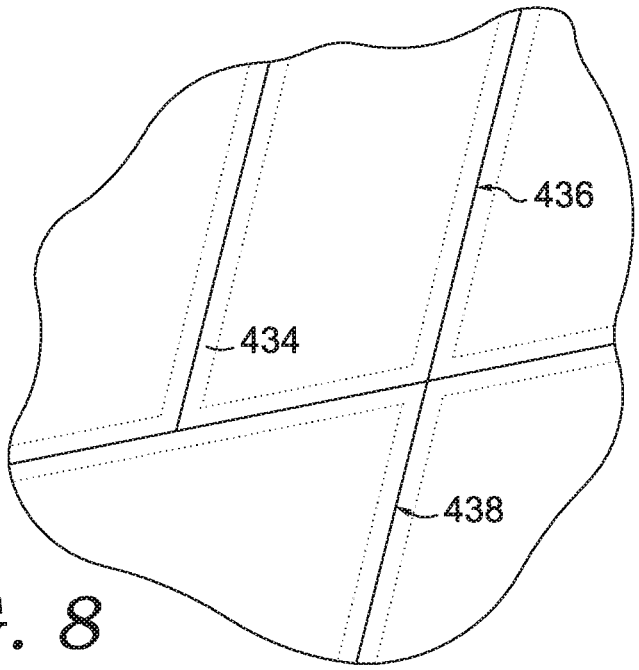

FIGS. 7-10 depict aspects of irregular seams. FIG. 7 depicts a first seam 422 and a second seam 424 that are curved in shape and that intersect one another so as to form a double-helix-type pattern. Fabric portions 426 and 428 may be inserted between fabric portions 430 and 432, for example. Heat-responsive adhesive tape may be placed in one or more areas of overlap 434. FIG. 8 depicts aspects of a plurality of irregular seams 436 that are linear is shape and path, having areas of overlap 438 for the placement of heat-responsive adhesive.

Figure 9:
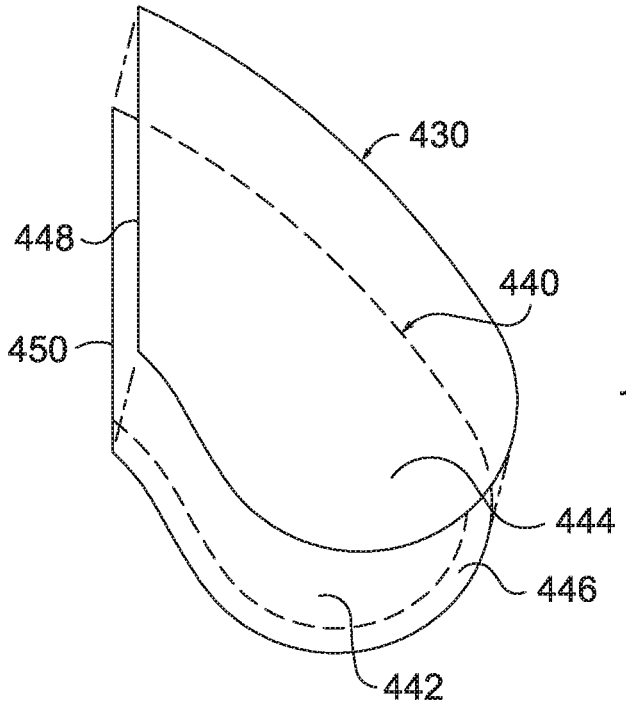
FIG. 9 is an expanded view of an exemplary garment portion that may be bonded using the exemplary methods of FIGS. 1-3 in accordance with aspects herein.

FIG. 9 depicts an exemplary irregular seam 440 formed by two portions of fabric 442 and 444, that when bonded, form a pocket template The two portions of fabric 442 and 444 are similar in size and shape, with an area of overlap 446 for bonding the two portions to each other. Then, the pocket may be inserted into a garment, leaving an edge 448 and 450 of each of the two portions 442 and 444 to form the opening to the pocket.

Figure 10:
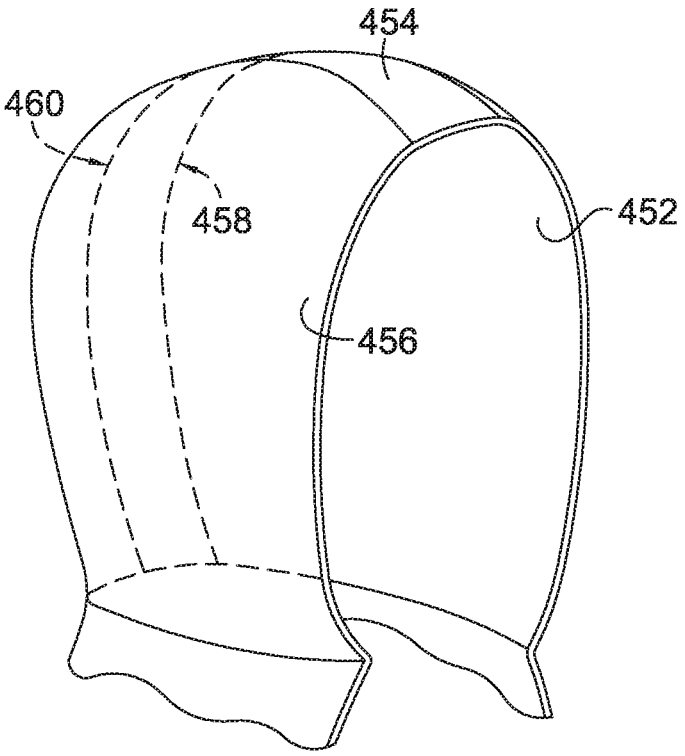
FIG. 10 is a perspective view of an exemplary garment portion that may be bonded using the exemplary methods of FIGS. 1-3 in accordance with aspects herein.

Turning to FIG. 10, it illustrates first, second, and third portions 452, 454, and 456 of fabric that may be bonded to each other, consecutively, by bonding along a first seam 458 and a second seam 460. As shown, the first seam 458 and the second seam 460 are curved seams. A curved seam generally refers to a seam that is non-linear in three-dimensions. A curved seam may be a seam that curves through several planes (e.g., x, y and z planes). In other words, curved seams are non-planar and follow a "path" that moves through multiple planes of space. It will be understood that some seams may be irregular and curved and that the two qualities are not contradictory. Exemplary curved seams, such as first and second seams 458 and 460, may be seams that are to be formed from fabric portions, the fabric portions being placed upon or draped over three-dimensional forms or surfaces. In contrast to the curved seams of FIG. 10 that curve through multiple planes, FIGS. 7 and 8 illustrate irregular seams that curve through only two planes (e.g., x and y planes). The exemplary structures described herein are applicable to the irregular seams of FIGS. 7 and 8, but are especially suited to bonding the curved seams described with regard to FIG. 10, and later, FIG. 14.

When bonded, the first, second, and third portions 452, 454, and 456 illustrated in FIG. 10 may form the hood of a jacket or coat, for example. As shown in FIG. 10, a curved seam may be three-dimensionally curved such that the seam is representative of the finished form of the garment. For example, seams 460 and 458 are three-dimensionally curved and represent the finished form of a hood of a jacket. Embodiments of the invention are particularly applicable to three-dimensionally curved seams such as those seams illustrated in FIGS. 10, 12, and 14 for instance. The embodiments of the invention are particularly suited to such applications to three-dimensionally curved seams that utilize irregular surfaces draped with fabric portions.

Figure 11:
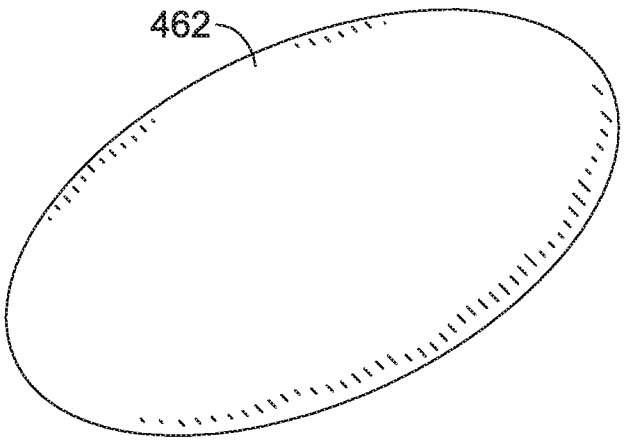
FIG. 11 is an exemplary structure for bonding garment seams in accordance with aspects herein.
Figure 12:
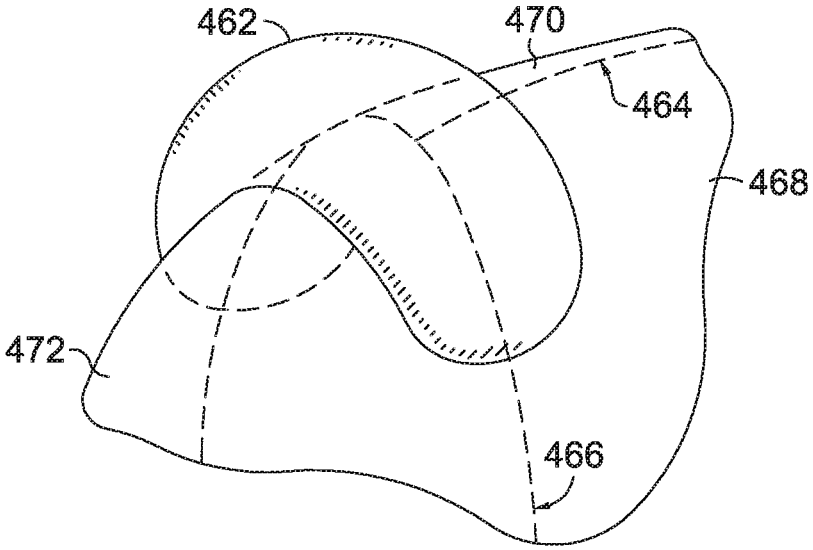
FIG. 12 illustrates the application of the exemplary structure of FIG. 11 to a seam in accordance with aspects herein.

FIGS. 11 and 12 depict a perspective view of exemplary structure 462 and the placement of the structure 462 upon materials that may be bonded to form one or more seams. The structure 462 may be ellipsoid or shaped like a ball, as well as partially filled with a conductive filling, for example. The exemplary seams 464 and 466 may correspond to a shoulder area portion of a clothing article. As shown, fabric portions 468, 470, and 472 have been draped or placed over an irregular surface that is a three-dimensional curved form so as to form seams 464 and 466. The irregular surface may mimic the final shape of a clothing article when worn, for example. The structure 462 may be placed upon the location of the desired seams, such as seams 464 and 466. Using the application of energy, the structure 462 may be used to heat a heat-responsive adhesive that bonds the fabric portions 468, 470, and 472 at and/or along the seams 464 and 466.

Figure 13:
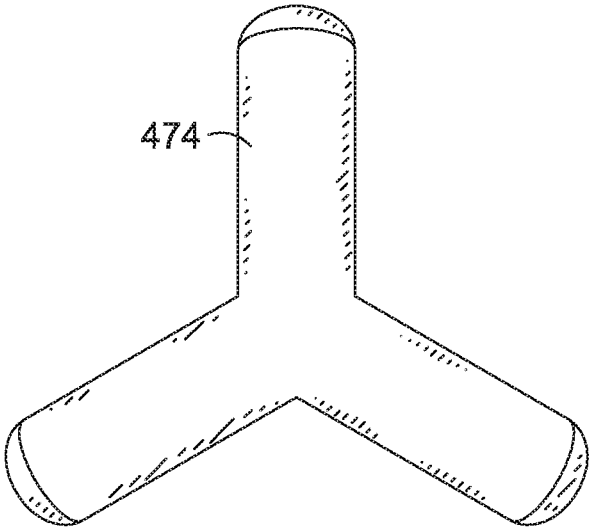
FIG. 13 is an exemplary structure for bonding garment seams in accordance with aspects herein.
Figure 14:
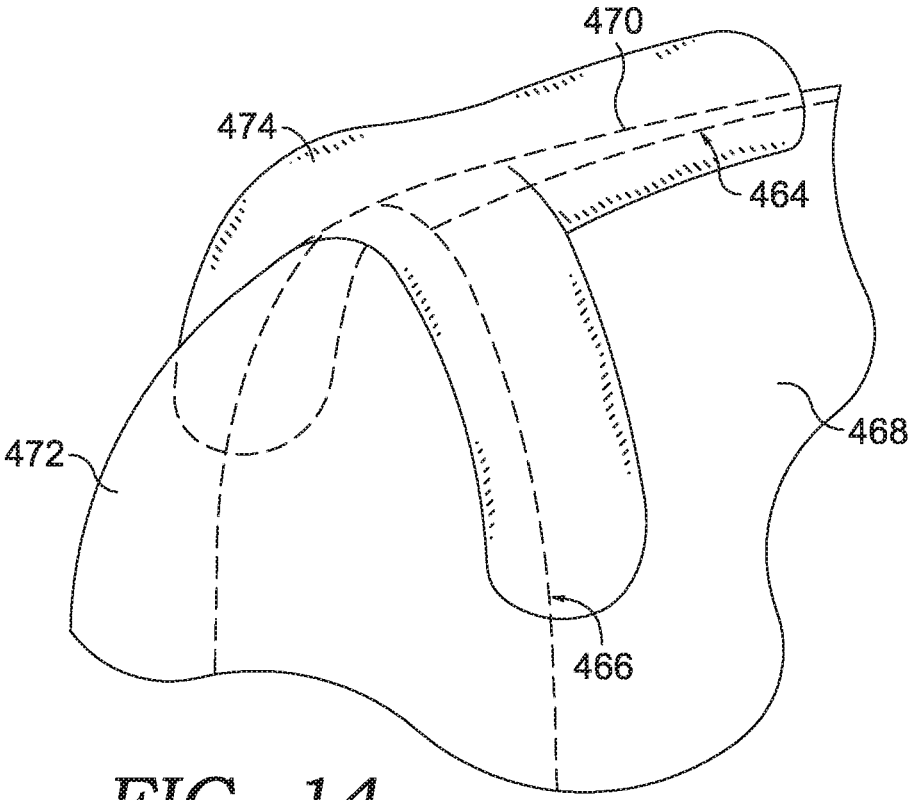
FIG. 14 illustrates the application of the exemplary structure of FIG. 13 to a seam in accordance with aspects herein.

FIGS. 13 and 14 depict a perspective view of exemplary structure 474 and the placement of the structure 474 upon materials that may be bonded to form a seam. The structure 474 is shaped as three cylinders that terminally connect to one another at the same point, in aspects. The structure 474 may be placed upon the location of the desired seams 464 and 466 that correspond generally to the shoulder area of a finished clothing article, for example, as draped on the irregular surface. Using the application of energy, the structure 474 may be used to heat a heat-responsive adhesive that bonds fabric portions 468, 470, and 472 along the seams 464 and 466. The structures shown, for example, in FIGS. 4, 11 and 13 are exemplary only. It is contemplated herein that the structures can be formed in any number of different configurations that are responsive to particular seaming configurations.

The present invention has been described in relation to particular aspects, which are intended in all respects to be illustrative rather than restrictive. Further, the present invention is not limited to these aspects, but variations and modifications may be made without departing from the scope of the present invention.

What is claimed is:

1. A method for using a heated structure to bond garment seams, the method comprising:

using an application of energy, heating a conductive filling enclosed within a flexible structure constructed from a fabric-type material and having three-dimensional conformability; and placing the flexible structure upon two or more portions of fabric at a location where the two or more portions of fabric contact one another to form an irregular garment seam, wherein heat of the conductive filling causes the two or more portions to bond to one another.

2. The method of claim 1, further comprising:

placing the two or more portions of fabric to create an area of overlap at the location where the two or more portions of fabric contact one another.

3. The method of claim 2, further comprising:

placing heat-responsive adhesive tape in contact with the two or more portions of fabric at the area of overlap.

4. The method of claim 1, wherein heating the conductive filling further includes inductively heating a ferromagnetic material of the conductive filling.

5. The method of claim 4, wherein the conductive filling further comprises a non-ferrous material.

6. The method of claim 1, further comprising:

placing heat-responsive adhesive tape in contact with the two or more portions of fabric at the location where the two or more portions of fabric contact one another.

7. The method of claim 1, further comprising:

placing heat-responsive adhesive tape across the two or more portions of fabric at the location where the two or more portions of fabric contact one another.

8. The method of claim 1, further comprising:

placing the two or more portions of fabric on a contoured surface such that the flexible structure having three-dimensional conformability conforms to the contoured surface when placed upon the two or more portions of fabric.

9. A method for using an inductively heated structure to bond garment seams, the method comprising:

inductively heating a conductive filling enclosed within a flexible structure constructed from fabric-type material and having three-dimensional conformability, wherein the flexible structure having three-dimensional conformability is adapted to conform to one or more of an irregular, non-planar surface and a seam on which the flexible structure is placed; and placing the flexible structure to contact two or more portions of fabric at a location where the two or more portions of fabric at least partially overlap one another, wherein the overlap corresponds to the seam, and wherein at least one portion of the two or more portions of fabric includes heat-bonding characteristics such that heat of the conductive filling causes the at least one portion to bond the two or more portions of fabric.

10. The method of claim 9, wherein the at least one portion of the two or more portions includes ferromagnetic fiber or ferromagnetic mesh.

11. The method of claim 10, further comprising:

inductively heating the ferromagnetic fiber or ferromagnetic mesh.

12. The method of claim 9, further comprising:

placing the two or more portions of fabric so as to at least partially overlap one another at the location.

13. The method of claim 9, wherein the at least one portion of the two or more portions includes a heat-bonding characteristic including a heat-responsive adhesive.

14. The method of claim 9, wherein the at least one portion of the two or more portions includes a heat-bonding characteristic including heat-melting fabric.

15. The method of claim 9, further comprising:

placing the two or more portions of fabric on an irregular surface that the flexible structure having three-dimensional conformability conforms to the irregular surface when placed upon the two or more portions of fabric.

16. A method for using an inductively heated structure to bond irregularly shaped seams, the method comprising:

positioning two or more edges of fabric adjacent one another to form a garment seam;

overlaying a heat-responsive adhesive tape with the garment seam;

placing a flexible structure on the garment seam, wherein the flexible structure is three-dimensionally conformable such that the flexible structure is constructed from fabric-type material and adapted to conform to a surface on which the flexible structure is placed; and via an inductive heating process, heating a conductive filling that at least partially fills the flexible structure and is enclosed therein, wherein heat from the conductive filling causes the heat-responsive adhesive tape to bond to the two or more edges of fabric.

17. The method of claim 16, wherein positioning the two or more edges of fabric adjacent one another to form the garment seam further includes overlapping the two or more edges of fabric with one another.

18. The method of claim 17, wherein overlaying the heat-responsive adhesive tape with the garment seam further includes overlaying the heat-responsive adhesive tape with at least a portion of an overlap of the two or more edges of fabric.

19. The method of claim 16, wherein positioning the two or more edges of fabric adjacent one another to form the garment seam includes placing the fabric on an irregular surface such that the flexible structure that is three-dimensionally conformable adapts to conform to the irregular surface when placed.

20. The method of claim 16, wherein the flexible structure is partially filled with the conductive filling including ferromagnetic material.

* * * * *